US009562722B2

(12) United States Patent
Porter et al.

(10) Patent No.: US 9,562,722 B2
(45) Date of Patent: Feb. 7, 2017

(54) MANIFOLD ASSEMBLY FOR DISTRIBUTING A FLUID TO A HEAT EXCHANGER

(75) Inventors: Kevin J. Porter, Syracuse, NY (US); William J. Heffron, Lafayette, NY (US)

(73) Assignee: Carrier Corporation, Jupiter, FL (US)

( * ) Notice: Subject to any disclaimer, the term of this patent is extended or adjusted under 35 U.S.C. 154(b) by 1302 days.

(21) Appl. No.: 13/256,390

(22) PCT Filed: Mar. 12, 2010

(86) PCT No.: PCT/US2010/027157

§ 371 (c)(1),
(2), (4) Date: Sep. 13, 2011

(87) PCT Pub. No.: WO2010/105170

PCT Pub. Date: Sep. 16, 2010

(65) Prior Publication Data

US 2012/0000635 A1 Jan. 5, 2012

Related U.S. Application Data

(60) Provisional application No. 61/160,025, filed on Sep. 13, 2009.

(51) Int. Cl.

| | |
|---|---|
| ***F28F 9/02*** | (2006.01) |
| ***F28D 7/02*** | (2006.01) |
| ***F28D 1/053*** | (2006.01) |
| ***F28F 13/08*** | (2006.01) |

(52) U.S. Cl.

CPC ..... *F28D 1/05316* (2013.01); *F28F 9/0282* (2013.01); *F28F 13/08* (2013.01); *F28F 2210/08* (2013.01); *Y10T 29/49389* (2015.01)

(58) Field of Classification Search

CPC ..... F28F 9/0212; F28F 9/013; F28F 9/0224; F28D 9/0025

USPC ..... 165/158, 165, 173, 174, 175

See application file for complete search history.

(56) References Cited

U.S. PATENT DOCUMENTS

| | | | | |
|---|---|---|---|---|
| 1,725,322 | A * | 8/1929 | Vezie | F28D 7/1646 165/146 |
| 1,988,659 | A | 4/1930 | Mont | |
| 1,948,550 | A * | 2/1934 | Voorheis | 165/68 |
| 2,065,708 | A * | 12/1936 | Keirle | F24D 3/087 165/146 |
| 2,310,234 | A * | 2/1943 | Haug | F28B 1/02 165/110 |

(Continued)

FOREIGN PATENT DOCUMENTS

| | | |
|---|---|---|
| EP | 0110545 | 6/1984 |
| EP | 0120630 | 10/1984 |

(Continued)

*Primary Examiner* — Len Tran
*Assistant Examiner* — Claire Rojohn, III
(74) *Attorney, Agent, or Firm* — O'Shea Getz P.C.

(57) ABSTRACT

A manifold assembly includes a first channel, a second channel and a manifold. The first channel has a first flow profile and a manifold end with a first cross-sectional geometry. The second channel has a second flow profile and a manifold end with a second cross-sectional geometry, which may be different than the first cross-sectional geometry. A first channel port of the manifold is configured to mate with the manifold end of the first channel. A second channel port of the manifold is configured to mate with the manifold end of the second channel.

18 Claims, 3 Drawing Sheets

(56) References Cited

U.S. PATENT DOCUMENTS

| | | | | |
|---|---|---|---|---|
| 3,983,903 | A * | 10/1976 | Kuehn, Jr. | F22B 37/74 122/406.3 |
| 4,168,742 | A * | 9/1979 | Kluppel et al. | 165/114 |
| 4,300,481 | A * | 11/1981 | Fisk | F22B 37/266 122/406.3 |
| 4,397,740 | A * | 8/1983 | Koontz | C07C 4/04 165/146 |
| 4,735,263 | A * | 4/1988 | Andro | F22B 37/18 122/406.3 |
| 5,139,083 | A * | 8/1992 | Larinoff | F28B 1/06 165/113 |
| 5,341,872 | A * | 8/1994 | Mercurio | F28F 9/0212 165/173 |
| 6,394,176 | B1 | 5/2002 | Marsais | |
| 7,398,819 | B2 | 7/2008 | Taras et al. | |
| 2002/0007646 | A1 * | 1/2002 | Manaka | 62/506 |
| 2002/0038702 | A1 * | 4/2002 | Font-Freide | B01J 19/0013 165/159 |
| 2004/0134640 | A1 * | 7/2004 | Sakakibara | F28D 7/1684 165/103 |
| 2006/0266502 | A1 * | 11/2006 | Khazani | F28D 1/05341 165/146 |
| 2007/0246206 | A1 * | 10/2007 | Gong | F28F 9/02 165/173 |
| 2008/0099191 | A1 | 5/2008 | Taras et al. | |
| 2008/0105420 | A1 | 5/2008 | Taras et al. | |

FOREIGN PATENT DOCUMENTS

| | | |
|---|---|---|
| GB | 2129539 | 5/1984 |
| JP | 2001059689 | 3/2001 |
| JP | 2001355975 | 12/2001 |
| WO | 2008000823 | 1/2008 |

* cited by examiner

MANIFOLD ASSEMBLY FOR DISTRIBUTING A FLUID TO A HEAT EXCHANGER

This patent application claims priority from Applicant hereby claims priority to PCT Patent Application no. PCT/US2010/027157 filed Mar. 12, 2010, which claims priority to U.S. Provisional Patent Application No. 61/160,025 filed Mar. 13, 2009, the disclosure of which is herein incorporated by reference.

BACKGROUND OF THE INVENTION

1. Technical Field

This disclosure relates generally to heat exchanger systems and, more particularly, to manifold assembly for a heat exchanger system.

2. Background Information

Heat exchanger systems, such as parallel flow heat exchanger systems ("parallel flow system"), are utilized in both condenser and evaporator applications for multiple products and system designs and configurations. Typically, a parallel flow system includes a heat exchanger, such as an evaporator, having a plurality of parallel passages which are fluidly coupled between a plurality of channels in an inlet manifold assembly and a plurality of channels in an outlet manifold assembly. In operation, coolant (sometimes referred to as refrigerant) is distributed into and flows through the passages of the heat exchanger in a substantially perpendicular flow direction to that of the inlet and the outlet manifold assemblies. As an air flow passes through the heat exchanger, heat is exchanged between the air flow and the coolant fluid.

Non-uniform distribution of coolant in heat exchanger systems, particularly in parallel flow systems due to flow design, is well-known in the art. Non-uniform distribution of coolant may occur due to differences in flow impedances and pressure drops within and across the passages of the heat exchanger, non-uniform airflow distribution over external heat transfer surfaces, improper heat exchanger orientation or poor manifold and distribution system design. For example, in parallel flow systems, non-uniform distribution is caused in part by the varying lengths of internal coolant distribution paths within the inlet and the outlet manifold assemblies which may lead to varying pressure drops across the passages.

In the prior art, the channels in the manifold assembly have been tuned to reduce the adverse effects of non-uniform coolant distribution. For example, in those instances where airflow distribution through the heat exchanger is non-uniform, the flow profile in each channel may be tuned such that more coolant flows through passages in the heat exchanger that are exposed to higher percentages of the airflow. However, manufacturing problems may arise where the manifold assembly includes channels having differently tuned flow profiles. For example, a first channel having a first flow profile may appear externally similar to a second channel having a second flow profile different than the first flow profile. This external similarity may lead to the improper placement of the different channels in the manifold assembly resulting in improper coolant flow characteristics.

SUMMARY OF THE DISCLOSURE

According to an aspect of the present invention, a manifold assembly for distributing a fluid to a heat exchanger is provided that includes a plurality of channels and a manifold. The plurality of channels includes one or more first channels and one or more second channels. The first channels each have a first flow profile and a manifold end with a first cross-sectional geometry. The second channels each have a second flow profile and a manifold end with a second cross-sectional geometry. The first cross-sectional geometry is different from the second cross-sectional geometry. The manifold has an inner cavity, an inlet port, one or more first channel ports, and one or more second channel ports. The first channel ports are each configured to mate with the manifold end of a first channel. The second channel ports are each configured to mate with the manifold end of a second channel.

According to another aspect of the present invention, a method for manufacturing a manifold assembly for distributing a fluid to a heat exchanger is provided. The method includes the steps of: a) providing a manifold having an inner cavity, one or more first channel ports each having a first port geometry, and one or more second channel ports each having a second port geometry, which second port geometry is different than the first port geometry; b) providing one or more first channels, each having a manifold end and a cell end, and each having a first flow profile, wherein the manifold end of each first channel mates with each first channel port; c) providing one or more second channels, each having a manifold end and a cell end, and each having a second flow profile, wherein the manifold end of each second channel mates with each second channel port; and d) mating the manifold end of each first channel to one of the first channel ports disposed within the manifold, and mating the manifold end of each second channel to one of the second channel ports disposed within the manifold, to fluidly couple the inner cavity of the manifold to the first and second channels.

DETAILED DESCRIPTION OF THE INVENTION

Figure 1:
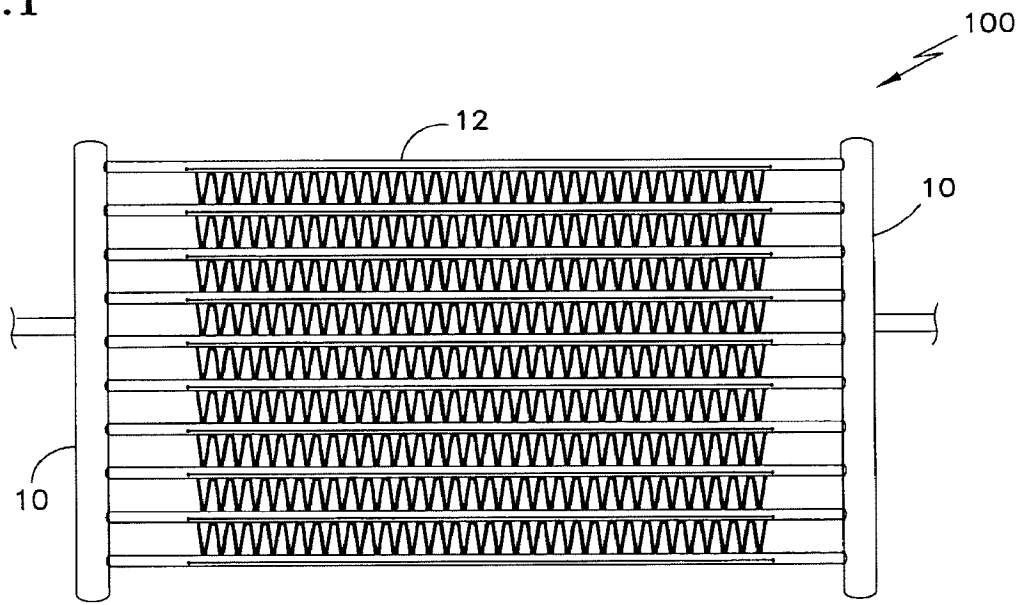
FIG. 1 is a diagrammatic illustration of one embodiment of a heat exchanger system.

FIG. 1 is a diagrammatic illustration of one embodiment of a heat exchanger system 100 for exchanging heat between an internally flowing fluid (e.g. coolant or refrigerant) and an externally flowing fluid (e.g. air). The heat exchanger system 100 includes at least one manifold assembly 10 and a heat exchanger 12 having at least one cell. It should be noted that in some embodiments, different cells of the heat exchanger 12 may be separated into physically separate units as known in the art (not shown).

Figure 2:
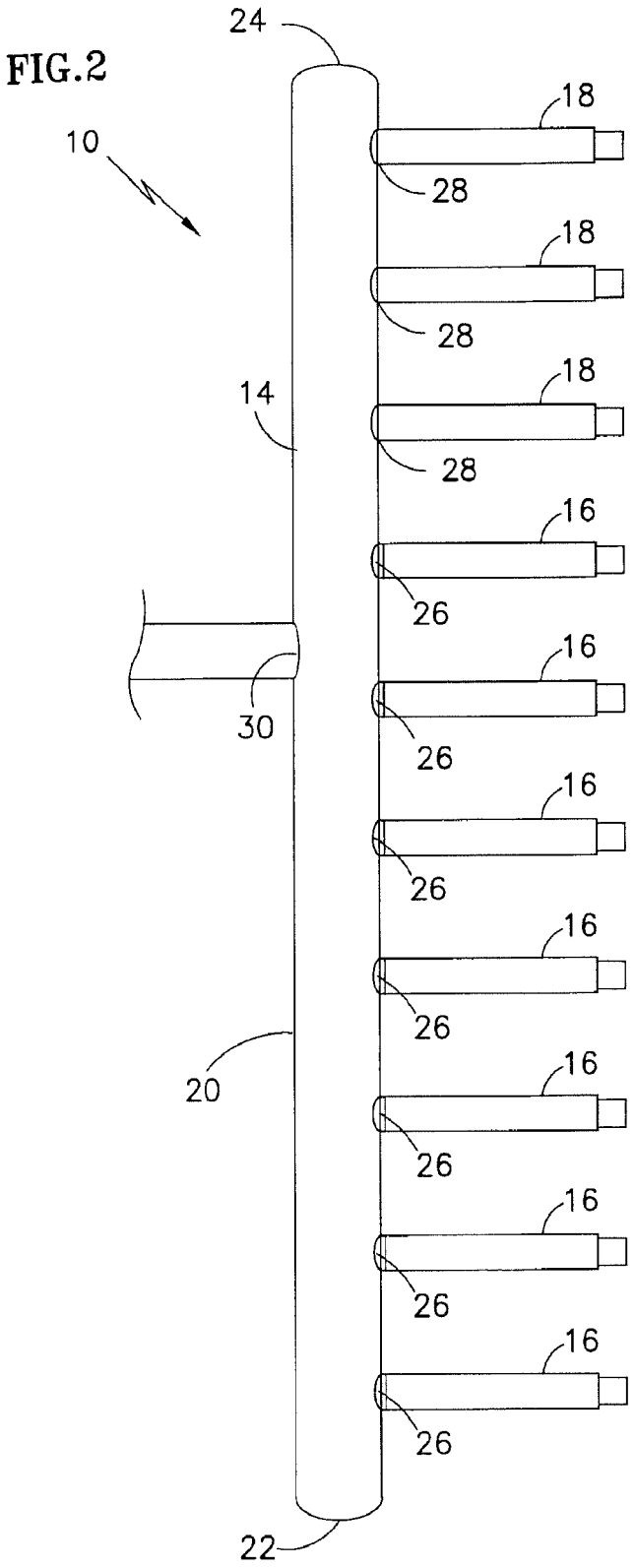
FIG. 2 is a diagrammatic illustration of one embodiment of a manifold assembly.

FIG. 2 is a diagrammatic illustration of one embodiment of a manifold assembly 10 for distributing a fluid to the one or more cells of the heat exchanger 12. The manifold assembly 10 includes a manifold 14 and a plurality of tubular channels (also referred to as "reamers"). The plurality of tubular channels include one or more first channels 16 and one or more second channels 18.

The manifold 14 includes an inner cavity 20 extending between a first end 22 and a second end 24, one or more first channel ports 26, one or more second channel ports 28, and an inlet port 30. The ports are fluidly coupled to the inner cavity 20. The first channel ports 26 each have a geometry that mates with the cross-sectional geometry of the manifold end of a first channel 16, as will be described below. The second channel ports 28 each have a geometry that mates with the cross-sectional geometry of the manifold end of a second channel 18, as will be described below. The geometry of the first channel ports 26 is different than the geometry of the second channel ports 28.

Figure 3:
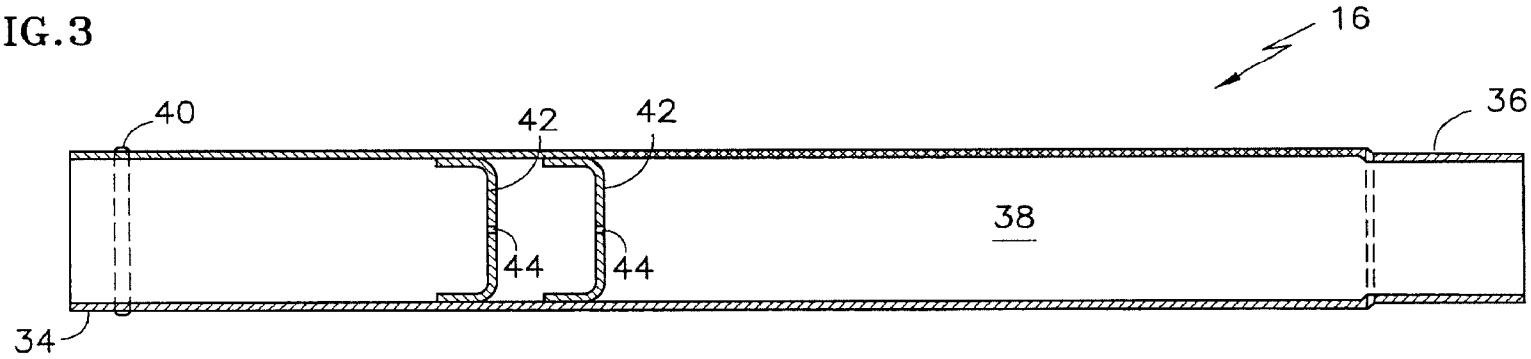
FIG. 3 is a diagrammatic illustration of one embodiment of a first channel.

Now referring to FIG. 3, each first channel 16 has a center section 32 extending between a manifold end 34 and a cell end 36, and an internal passage 38. The internal passage extends all the way through the first channel 16 between the manifold end 34 and the cell end 36 to allow the passage of fluid through channel. The manifold end 34 has a cross-sectional geometry and the cell end 36 has a cross-sectional geometry. In some embodiments, the cross-sectional geometry of the cell end 36 is different from the cross-sectional geometry of the manifold end 34. In the example shown in FIG. 3, the manifold end 34, center section 32, and cell end 36 have circular cross-sections. The diameter of the manifold end 34 equals that of the center section 32, and the cell end 36 has a smaller diameter than both. The aforesaid cross-sectional geometries are not limited to being circular, and the relative diameters can change to suit the application at hand. In some embodiments, a first shoulder 40 or solder bead is disposed circumferentially around the first channel 16.

In most embodiments, the first channel 16 has a feature that creates a difference in pressure between the manifold end 34 and the cell end 36. The difference in pressure is greater than piping losses typically due to friction or other factors such as the configuration of the piping. The feature may be a change (e.g., a constriction) in the cross-sectional area of the first channel 16, or it may be an element operable to obstruct flow within the passage 38. A cup-shaped flow restrictor 42 having an orifice 44 through which the flow must pass is an example of a feature that can be disposed within the passage 38 of the first channel 16 to obstruct flow and thereby create a difference in pressure for flow passing through the first channel 16. The present invention is not limited to any particular type of feature. The feature is selectively chosen to create a particular difference in pressure across the first channel 16 under expected operating conditions, which difference in pressure may be generically referred to as a first flow profile.

Figure 4:
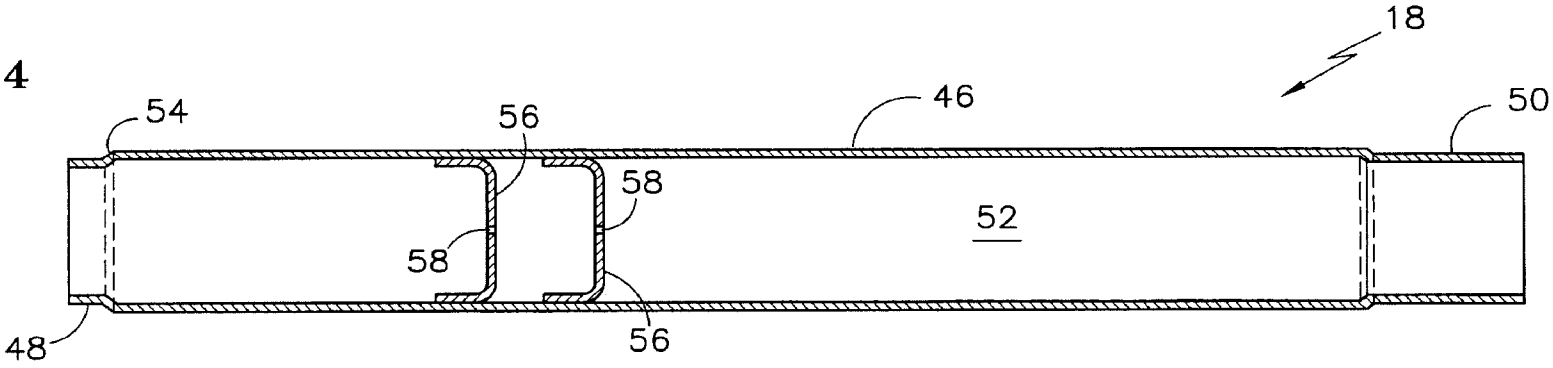
FIG. 4 is a diagrammatic illustration of one embodiment of a second channel.

Now referring to FIG. 4, a second channel 18 has a center section 46 extending between a manifold end 48 and a cell end 50, and an internal passage 52. The internal passage 52 extends all the way through the second channel 18 between the manifold end 48 and the cell end 50 to allow the passage of fluid through the channel. The manifold end 48 has a cross-sectional geometry and the cell end 50 has a cross-sectional geometry. In some embodiments, the cross-sectional geometry of the cell end 50 is different from the cross-sectional geometry of the manifold end 48. In the example shown in FIG. 4, the manifold end 48, center section 46, and cell end 50 have circular cross-sections. The diameter of the manifold end 48 is less than that of both the center section 46 and cell end 50, and the cell end 50 has a smaller diameter than the center section 46. The aforesaid cross-sectional geometries are not limited to being circular, and the relative diameters can change to suit the application at hand. In some embodiments, a first shoulder 54 or solder bead is disposed circumferentially around the second channel 18.

The cross-sectional geometry of the manifold end 48 of the second channels 18 is different from the cross-sectional geometry of the manifold end 34 of the first channels 16. As a result, the manifold end 48 of each second channel 18, which mates with a second channel port 28 disposed in the manifold 14, will only mate with a second channel port 28 and will not mate with a first channel port 26 disposed within the manifold 14. The first channel ports 26 are configured to mate with a manifold end 34 of a first channel 16. The terms "mate" and "mating" are used here to describe a connection between a manifold end of a channel and a manifold port, where the end and the port physically match (e.g., one can be received within the other) in a manner such that the fit between the two permits sealing of leakage therebetween.

In most embodiments, the second channel 18 has a feature that creates a difference in pressure between the manifold end 48 and the cell end 50. The feature may be a change (e.g., a constriction) in the cross-sectional area of the first channel 16, or it may be an element operable to obstruct flow within the passage 52. A cup-shaped flow restrictor 56 having an orifice 58 through which the flow must pass is an example of a feature that can be disposed within the passage 52 of the first channel 16 to obstruct flow and thereby create a difference in pressure for flow passing through the first channel 16. The present invention is not limited to any particular type of feature. The feature is selectively chosen to create a particular difference in pressure across the second channel 18 under expected operating conditions, which difference in pressure may be generically referred to as a second flow profile.

Assembling the first and second channels 16, 18 to the manifold 14 requires that the intended channel be mated with the intended channel port within the manifold 14. Correctly positioning the channels relative to the manifold 14, ensures that the intended channel flow profile is matched with the intended region within the heat exchanger 12. In the prior art, the potential existed for placing the first and second channels 16, 18 in incorrect positions because the first and second channels 16, 18 often looked quite similar from their exterior and interchangeable relative to the manifold. Under the present manifold assembly, the position of the first channels 16 and second channels 18 relative to the manifold 14 are dictated by the mating geometries of the manifold ends 34, 48 of the first and second channels 16, 18 and the first and second channel ports 26, 28 of the manifold 14. As stated above, the cross-sectional geometry of the manifold end 48 of a second channel 18 is different from the cross-sectional geometry of the manifold end 34 of a first channel 16. As a result, the manifold end 48 of each second channel 18 will only mate with a second channel port 28 disposed within the manifold 14, and the manifold end 34 of each first channel 16 will only mate with a first channel port 26 disposed within the manifold 14.

In operation, a fluid enters the heat exchanger system 100 through the inlet port 30 in the manifold assembly 10. The fluid flows from the inlet port 30, into the inner cavity 20 of the manifold 14, through the first and second channels 16, 18, and into the heat exchanger 12. The specific flow pattern of the fluid is dictated in part by the flow profiles of the first and second channels 16, 18. Hence, the first and second channels 16, 18 are positioned relative to the manifold 14 and heat exchanger 12 so that the flow profile of the particular channel creates the desired fluid flow in the aligned region of the heat exchanger 12. As a result, the manifold assembly 10 creates a selectively chosen non-uniform flow of fluid into the heat exchanger 12 that is subject to a non-uniform cross-flow, thereby improving the performance of the heat exchanger 12.

One embodiment of a method is disclosed for manufacturing the manifold assembly 10 illustrated in FIG. 1. Although the method includes various steps, it should be noted that the order of the steps is not fixed and the steps may be performed in a variety of different orders. Further, in some embodiments, some steps may be deleted or combined into single steps. In step (a), a manifold 14 having an inner cavity 20, one or more first channel ports 26 each having a first port geometry, and one or more second channel ports 28 each having a second port geometry is provided. The second port geometry is different than the first port geometry. In step (b), one or more first channels 16, each having a manifold end, a cell end, and a first flow profile, are provided. The manifold end of each first channel 16 mates with each first channel port 26. In step (c), one or more second channels 18, each having a manifold end, a cell end, and a second flow profile, are provided. The manifold end of each second channel 18 mates with each second channel port 28. In step (d), the manifold end of each first channel 16 is mated to one of the first channel ports 26 disposed within the manifold, and the manifold end of each second channel 18 is mated to one of the second channel ports 28 disposed within the manifold, to fluidly couple the inner cavity 20 of the manifold to the first and second channels 16, 18.

While various embodiments of the present invention have been disclosed, it will be apparent to those of ordinary skill in the art that many more embodiments and implementations are possible within the scope of the invention. Accordingly, the present invention is not to be restricted except in light of the attached claims and their equivalents.

What is claimed is:

1. A manifold assembly for distributing a fluid to a heat exchanger, comprising:

a plurality of channels including one or more first channels and one or more second channels, which first channels each have a first flow profile and a manifold end with a first cross-sectional geometry, and which second channels each have a second flow profile and a manifold end with a second cross-sectional geometry, wherein the first cross-sectional geometry is different from the second cross-sectional geometry; and a tubular manifold extending along a longitudinal centerline, the tubular manifold having an inner cavity, an inlet port, one or more first channel ports each configured to mate with the manifold end of a first channel, and one or more second channel ports each configured to mate with the manifold end of a second channel;

wherein a geometry of one of the first channel ports is different than a geometry of one of the second channel ports; and wherein the one or more first channel ports and the one or more second channel ports are respectively disposed at discrete locations along the longitudinal centerline.

2. The manifold assembly of claim 1, where the manifold end of each first channel has a circular first cross-sectional geometry with an outer diameter, and the manifold end of each second channel has a circular second cross-sectional geometry with an outer diameter, and the outer diameter of the manifold end of the second channel is smaller than outer diameter of the manifold end of the first channel.

3. The manifold assembly of claim 2, wherein the first channel ports have an inner diameter, and the second channel ports have an inner diameter, and the outer diameter of the manifold end of the first channel is greater than the inner diameter of each of the second channel ports.

4. The manifold assembly of claim 1, where the manifold end of the each first channel is configured to be received within one of the first channel ports of the tubular manifold.

5. The manifold assembly of claim 1, where the manifold end of the each second channel is configured to be received within one of the second channel ports of the tubular manifold.

6. The manifold assembly of claim 1, wherein the first flow profile is different from the second flow profile.

7. A manifold assembly for distributing a fluid to a heat exchanger, comprising:

a plurality of channels including one or more first channels and one or more second channels, which first channels each have a first flow profile and a manifold end, and which second channels each have a second flow profile and a manifold end; and a tubular manifold extending along a longitudinal centerline, the tubular manifold having an inner cavity, an inlet port, one or more first channel ports each configured to mate with the manifold end of a first channel, and one or more second channel ports each configured to mate with the manifold end of a second channel;

wherein a geometry of one of the first channel ports is different than a geometry of one of the second channel ports; and wherein the one or more first channel ports and the one or more second channel ports are respectively disposed at discrete locations along the longitudinal centerline.

8. The manifold assembly of claim 7, where the manifold end of each first channel has a circular first cross-sectional geometry with an outer diameter, and the manifold end of each second channel has a circular second cross-sectional geometry with an outer diameter, and the outer diameter of the manifold end of the second channel is smaller than outer diameter of the manifold end of the first channel.

9. The manifold assembly of claim 8, wherein the first channel ports have an inner diameter, and the second channel ports have an inner diameter, and the outer diameter of the manifold end of the first channel is greater than the inner diameter of each of the second channel ports.

10. The manifold assembly of claim 7, where the manifold end of the each first channel is configured to be received within one of the first channel ports of the tubular manifold.

11. The manifold assembly of claim 7, where the manifold end of the each second channel is configured to be received within one of the second channel ports of the tubular manifold.

12. The manifold assembly of claim 7, wherein the first flow profile is different from the second flow profile.

13. The manifold assembly of claim 7, wherein the longitudinal centerline is a straight longitudinal centerline.

14. The manifold assembly of claim 1, wherein the longitudinal centerline is a straight longitudinal centerline.

15. The manifold assembly of claim 1, wherein the plurality of channels are discrete from and configured to be respectively fluidly coupled with conduits of the heat exchanger.

16. A heat exchanger assembly, comprising:

a first manifold assembly comprising:

a plurality of channels including one or more first channels and one or more second channels, which first channels each have a first flow profile and a manifold end with a first cross-sectional geometry, and which second channels each have a second flow profile and a manifold end with a second cross-sectional geometry, wherein the first cross-sectional geometry is different from the second cross-sectional geometry; and a manifold having an inner cavity, an inlet port, one or more first channel ports each configured to mate with the manifold end of a first channel, and one or more second channel ports each configured to mate with the manifold end of a second channel;

wherein a geometry of one of the first channel ports is different than a geometry of one of the second channel ports;

a second manifold assembly; and a heat exchanger fluidly coupled between the first manifold assembly and the second manifold assembly, the heat exchanger comprising a plurality of conduits, wherein each of the conduits is discrete from and fluidly coupled with a respective one of the plurality of channels.

17. The heat exchanger assembly of claim 16, wherein the heat exchanger further comprises a plurality of fins disposed between an adjacent pair of the conduits.

18. The heat exchanger assembly of claim 16, wherein the manifold is a tubular manifold that extends along a longitudinal centerline, and the one or more first channel ports and the one or more second channel ports are respectively discretely disposed along the longitudinal centerline.

* * * * *